United States Patent [19]

Robertsson

[11] 4,218,834

[45] Aug. 26, 1980

[54] SCORING OF SIMULATED WEAPONS FIRE WITH SWEEPING FAN-SHAPED BEAMS

[75] Inventor: Hans R. Robertsson, Jönköping, Sweden

[73] Assignee: Saab-Scania AB, Linkoping, Sweden

[21] Appl. No.: 14,115

[22] Filed: Feb. 22, 1979

[30] Foreign Application Priority Data

Mar. 2, 1978 [SE] Sweden ..... 7802350

[51] Int. Cl.[3] ..... F41F 27/00; F41G 3/26

[52] U.S. Cl. ..... 35/25; 89/41 L; 235/412; 455/609; 273/312; 356/5; 356/152

[58] Field of Search ..... 35/25; 273/102.2 R, 273/102.2 B; 356/4, 5, 152; 250/199, 203 R; 89/41 L; 364/423; 235/412

[56] References Cited

U.S. PATENT DOCUMENTS

| | | | |
|---|---|---|---|
| 3,007,635 | 11/1961 | Miner et al. | 235/412 |
| 3,056,129 | 9/1962 | Albersheim | 343/11 VB |
| 3,484,167 | 12/1969 | Burns, Jr. | 356/5 |
| 3,588,108 | 6/1971 | Ormiston | 273/102.2 R |
| 3,609,883 | 10/1971 | Erhard | 35/25 |
| 3,832,791 | 9/1974 | Robertsson | 35/25 |
| 3,907,433 | 9/1975 | Nault | 35/25 |

FOREIGN PATENT DOCUMENTS

| | | | |
|---|---|---|---|
| 2149701 | 4/1973 | Fed. Rep. of Germany | 35/25 |
| 1161027 | 8/1969 | United Kingdom | 244/3.16 |

*Primary Examiner*—S. C. Buczinski
*Attorney, Agent, or Firm*—Nilles & Custin

[57] ABSTRACT

For scoring of simulated firing of a weapon, having flatwise-angularly sweeping beams of radiation, emitted at the weapon location during a period beginning at or about the instant of simulated firing are used for measuring the position of a target retroreflector in range and in functions of azimuth and elevation. During the same period a calculation is made of the instantaneous positions in range, and in functions of azimuth and elevation, of an imaginary projectile fired from the weapon at the firing instant under conditions then existing, and the relationship is ascertained between the imaginary projectile and each beam in its angular position at interception by the retroreflector. At a scoring instant, when weapon-to-reflector distance equals weapon-to-projectile distance, or when the projectile is at a predetermined elevation relative to the reflector, scoring is based on the relationship of projectile to angular beam position at that instant. Scoring results can be displayed at the weapon location and/or transmitted to the target in beam modulation for evaluation of hit effect at the target.

12 Claims, 11 Drawing Figures

SCORING OF SIMULATED WEAPONS FIRE WITH SWEEPING FAN-SHAPED BEAMS

FIELD OF THE INVENTION

This invention relates to a method and apparatus for scoring simulated firing of a weapon, and the invention is more particularly concerned with a versatile system, capable of cooperating with a wide variety of weapons, that employs beams of radiation to provide highly accurate and prompt scoring results at the weapon location and/or at the target.

BACKGROUND OF THE PRIOR ART

Several systems for scoring simulated weapons fire have heretofore been proposed wherein a beam of radiation was used to simulate a projectile fired from the barrel of a weapon and wherein aiming of the weapon was scored on the basis of whether or not the beam was detected either by a detector located at the target or by a detector located at the weapon position and towards which the beam could be reflected by a retroreflector on the target.

Any such system must take account of the fact that a real projectile follows a curving track and takes a substantial amount of time to move from the weapon position to the target area, whereas a beam of radiation follows a straight path and moves from the weapon position to the target area in an extremely short period of time.

U.S. Pat. No. 3,609,883 disclosed a system wherein, at the instant of simulated firing of the weapon, a calculation was begun, based upon the superelevation of the weapon barrel at that instant, of the trajectory that would have been followed by a real projectile fired from the weapon at that instant. In accordance with that calculation, the axis of a laser emitter was depressed relative to the orientation of the weapon barrel axis at the firing instant, and after a time interval equal to the calculated projectile flight, a narrow beam of radiation was emitted towards the calculated point at which the imaginary projectile was assumed to have terminated its flight. A hit or miss was scored on the basis of whether or not the beam fell upon a detector at the target.

One disadvantage of that system was that it required the use of some means independent of the laser apparatus for measuring range distance between the weapon and the target. A more important disadvantage was that the system could not register anything but a miss if the laser beam did not strike a radiation detector—even when the beam missed the detector by a distance so small as to be practically insignificant. For anything other than hit-or-miss scoring, the target body would have had to be literally covered with detectors; and even with that costly arrangement, near misses could not have been scored for simulated shots falling just outside the limits of the target body. For effective training accurate scoring of near misses is important because only from such scoring can the gunner learn what kind of errors he is making.

U.S. Pat. No. 3,588,108 disclosed a simulated weapons fire system wherein a laser beam was moved in an area-search type of scanning sweep at the time of termination of the calculated trajectory of an imaginary projectile, and was modulated at different frequencies in different sectors of the area swept during its scan,. On the basis of the modulation frequency impressed upon a detector at the target by the sweeping beam, accuracy of aim could be scored in terms of near misses as well as direct hits and complete misses. The field of scan of the sweeping laser beam had to be large enough so that two or more targets might intercept it if they were relatively close to one another, with consequently inaccurate and confusing scoring results, and therefore the system could be used only with simulations of limited tactical situations. The system tended to be inaccurate with moving targets, and it required signaling means or a special transmitter at each target for transmitting scoring information back to the weapon location.

U.S. Pat. No. 3,832,791 disclosed a gunnery training scoring system wherein a first radiation emission at the instant of simulated firing was employed for ranging, to ascertain the duration of the time interval theoretically required for a round of a selected type of ammunition to arrive at the detected position of the target; and at the end of that interval a second emission was used to obtain a fix on the target and to transmit information to the target concerning ammunition type and the point of impact of the simulated projectile in relation to the then-existing position of the target. Such information was encoded in modulation of the beam and was decoded at the target to be used for evaluating hit effect. The beam in that case was a substantially divergent one, having an angular height equal to the angle through which the weapon barrel could be swung in elevation and a width to cover an entire target body at minimum shooting distance. By reason of this diffusion, only a small portion of the total emitted radiation could reach any particular detector in the system, and therefore received signal strength was relatively low and there was a correspondingly low ratio of signal to background disturbance.

In common with the system of U.S. Pat. No. 3,588,108, the last described system had the further and more serious objection that if there were, for example, two targets within the relatively wide space illuminated by the beam, both at about the same distance from the weapon location and each denoted by a reflector and an adjacent detector, both detectors would receive information encoded in the beam, even though the information was valid for only one of them.

The above mentioned technical disadvantages of the respective prior scoring systems generally resulted in inaccurate scoring, at least under cetain conditions, and also tended to impose limitations upon each such system with respect to the simulated tactical situations in which it could be used effectively.

The general object of the present invention is to provide a scoring system for simulated weapons fire that overcomes or avoids the technical disadvantages possessed by prior systems and is, in addition, much more versatile, being capable not only of simple hit-or-miss scoring but also of accurate hit effect scoring in realistically simulated complex tactical situations. With respect to versatility, it will have been observed that each of the above described prior systems required the presence of a detector at the target, along with receiving equipment associated with the detector. By contrast, the system of the present invention operates in one mode wherein the target need only be equipped with a reflector by which radiation from the weapon location is reflected back to that location, so that scoring can be effected there, but has another mode of operation in which the target is equipped with a detector in addition to the reflector and in which calculation is made at the target body of the hit effect upon the target body that has been achieved with each simulated shot. Thus, in contrast to prior scoring systems, each of which usually had only one mode of operation, apparatus embodying the principles of this invention can be of a rather simple type for basic target practice work and can be elaborated, building-block fashion, to accommodate itself to increasing sophisticated scoring of increasingly complex simulated tactical situations, in accordance with training requirements and budget limitations.

The present invention contemplates the employment of modulated, fan-shaped beams of radiation, swept flatwise angularly, in connection with a system for scoring of simulated weapon fire. With respect to the employment of such beams in certain modes of operation of the system of this invention and under certain conditions, the present disclosure is supplemented by my copending applications Ser. No. 14,117 and Ser. No. 14,116.

Ser. No. 14,117 discloses a method and apparatus for employing such sweeping beams to determine the positions of each of a plurality of targets in a space swept by the beams, wherein there is no presentation of spurious target positions such as occurred with prior systems using angularly sweeping fan-shaped beams when multiple targets were present in the swept space. My other copending application, Ser. No. 14,116, discloses a method and apparatus for causing information transmitted by modulation of such beams to be delivered exclusively to such of the targets in the swept space as are at a predetermined distance, or at predetermined distances, from the location from which the beams are emitted.

Heretofore in weapons practice systems in which radiation from a laser or the like has been employed, the laser radiation has been used to simulate the projectile fired at the target. Thus the beam of radiation was emitted at the time following the firing instant when a real projectile, had it been fired at that time, would have arrived at the target; and the beam was so directed that it intersected the point in space at which the real projectile would have arrived at the end of its time of flight. It is obvious that fan-shaped, flatwise-swept beams cannot be employed in that manner. But it has not been obvious how fan-shaped sweeping beams can be employed in such a training system, and in fact it has not heretofore been evident that there would be any advantage in the use of such beams, even assuming that there was a solution to the problems heretofore recognized as inherent in their use.

Nevertheless, the general object of the present invention is to provide a method and apparatus for the scoring of simulated weapon fire which is both more accurate and more versatile than simulated weapons fire scoring systems heretofore known, and which employs fan-shaped beams of radiation that are angularly swept flatwise.

With respect to accuracy, it is an object of this invention to provide a method and apparatus that makes possible the accurate scoring of simulated weapon fire on the basis of hit effect, that is, on the basis of the amount and kind of damage that would have been inflicted upon a predetermined target body by a real projectile of a predetermined type if it had been fired by the gunner under all of the relevant conditions that existed at the instant of simulated firing.

With respect to versatility, it is an object of this invention to provide for accurate scoring of simulated firing at either fixed or moving targets, from a stationary or a mobile weapon position, with a slow-firing or a rapid-firing weapon, and with ballistic, self-propelled, guided or unguided projectiles, and to enable such scoring to be accomplished with great accuracy at the weapon location and/or at a target position. It is also an object of the invention to provide such a scoring system which is versatile enough to be readily adaptable for use in simulated land warfare or sea warfare and in simulated ground-to-air, air-to-ground and air-to-air operations.

A further and very important object of this invention is to provide a system for scoring of simulated weapons fire wherein laser radiation is emitted from the weapon location but wherein each target need only comprise a retroreflector, no radiation detector being needed at the target to enable the gunner to obtain prompt and useful information at the weapon location about the results achieved with each simulated shot.

It is also an object of the invention to provide a simulated weapons fire scoring system that affords accurate scoring of near misses as well as hits, enables a prompt evaluation to be made of the hit effect achieved with each simulated shot, and provides for prompt display of scoring results at the weapon location and/or at all target locations or only at such target locations as are of interest.

SUMMARY OF THE INVENTION

It may be helpful to point out initially that, although the method and apparatus of the present invention employs radiation from a laser or the like, such radiation is emitted differently than in prior simulator systems. In the system of this invention, the radiation is emitted in fan-shaped beams that are periodically and alternately swept flatwise angularly across a solid angle space which has the weapon location at its apex and which is so oriented that the beams can be expected to sweep across the target. The present invention represents a further and very marked departure from the prior art in that the radiation is not employed to simulate the track or point of impact of an imaginary projectile but the beams are instead employed to take measurements on the basis of reflections of their radiation that are returned to the weapon position from the target. Simulated firing initiates a calculation of successive positions in its trajectory of an imaginary projectile that is assumed to have been fired from the weapon under conditions prevailing at the instant of simulated firing. When the calculated position of the imaginary projectile and the measured position of the target are found to have a predetermined relationship—as when the calculated distance to the projectile is equal to measured range distance to the target—the position of the imaginary projectile is compared with the then existing position of the target as ascertained by the momentary angular positions of the sweeping beams. The results of that comparison, which constitute scoring information, can be displayed at the weapon location. Alternatively, the sweeping beams can be modulated to transmit to the target information about the relationship between the projectile and the target at the scoring instant, together with information about the nature of the imaginary projectile, as selected by the gunner, and such transmitted information can be employed at the target for an accurate calculation of the hit effect produced by the imaginary projectile.

In general, the objects of the invention are obtained by a method of employing radiation, such as that of a laser, in scoring simulated firing of a weapon against a target comprising a reflector that reflects radiation in the direction opposite to the one from which it arrived at the reflector, which method is characterized by: beginning at the instant of simulated firing of the weapon, generating at the weapon location a calculated trajectory output which substantially signifies the position that a hypothetical projectile would have in its trajectory at successive instants if it had been fired from the weapon at the instant of simulated firing and which comprises calculated range magnitudes related to the location of the weapon at said instant and other calculated position magnitudes which are related to a predetermined axis extending from the weapon generally in a direction in which the trajectory is oriented; emitting radiation from the weapon location in the form of at least two fan-shaped beams, each having a long cross-section dimension which increases with increasing distance from the weapon location and a narrow cross-section dimension transverse to said long dimension, said long dimension of every beam being at an angle to that of every other beam, and each of said at least two beams being swept angularly, substantially transversely to its said long dimension, across a solid angle space which has the weapon location at its apex; each time radiation of a beam is returned to the weapon location by reflection from said reflector, generating at the weapon location a measured output which comprises a range magnitude which is determined on the basis of time elapsed between emission of radiation and detection of the reflection thereof at the weapon location and which is a function of the distance between the reflector and the weapon location and is thus comparable with said measured range magnitude, and a beam angle magnitude which is a function of the then-existing angular position of the beam and which is related to said axis and is thus comparable with at least one of said other calculated position magnitudes; and from time to time comparing one of said measured magnitudes with the comparable calculated magnitude so that when a predetermined relationship between the compared magnitudes is found to exist, the remaining calculated magnitudes can be compared for scoring purposes with the remaining measured magnitudes.

BRIEF DESCRIPTION OF THE DRAWINGS

In the accompanying drawings, which illustrate the invention in the embodiments of it that are now considered preferred modes of practice of its principles.

DETAILED DESCRIPTION OF THE INVENTION

Figure 1:
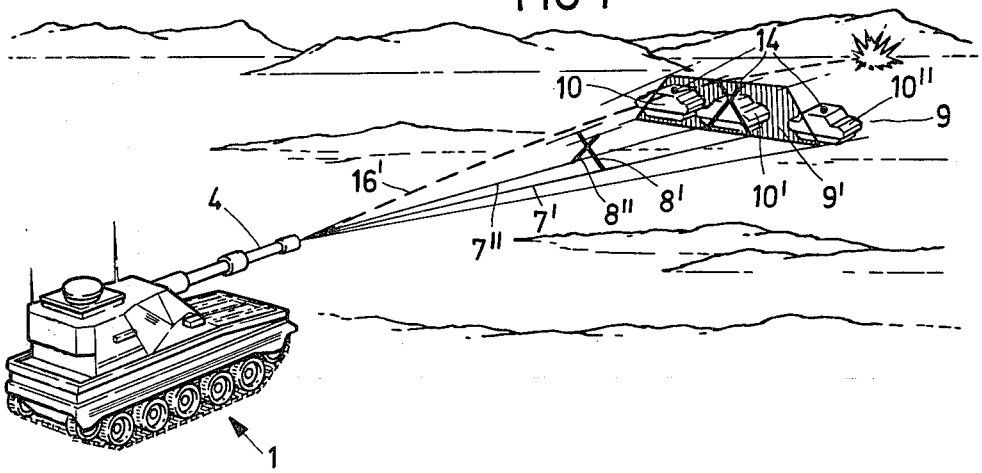
FIG. 1 is a perspective view of a simulated tactical situation in which the principles of the present invention are advantageously applied.

A weapons fire practice scoring system embodying the principles of the present invention can cooperate, for example, with a conventional weapon having a barrel 4, one form of such weapon being illustrated in FIG. 1 as a cannon mounted on a tank 1. The invention can also be employed with a guided missile launcher or similar weapon system that does not have a barrel.

In the following explanation it will be assumed that the gunner is aiming the weapon of the tank 1 at one of a group of targets 10, 10′, 10″ in a target area 9. The targets 10, 10′, 10″, illustrated as real or dummy tanks, simulate an enemy tank column or vehicle convoy and can be stationary or movable. It will be understood that the principles of this invention are applicable to targets that also comprise weapon locations from which simulated firing is conducted, so that the tank 1 in FIG. 1 may constitute a target for any one of its targets 10, 10′, 10″. If every weapon/target (tank or the like) is equipped with the scoring apparatus hereinafter described, the invention can be employed in very realistic simulations of such fast-moving tactical situations as tank duels.

The portion of the scoring apparatus of this invention that is at the weapon location comprises a laser emitter 2 and a laser radiation detector 3, both preferably detachably mounted on or in the barrel 4 of the weapon. The weapon is in all respects aimed and fired as if actual projectiles were being shot from it, but for each simulated firing the laser emitter 2 is caused to emit pulsed, angularly sweeping fan-shaped beams 7′, 7″. Such beam emission can begin before the firing instant, or at the firing instant (as is usually preferred), or shortly after the firing instant; but in any case it continues through a calculation period that can terminate at or shortly after a scoring instant when an imaginary projectile fired from the weapon either completes a calculated trajectory or completes that part of its calculated trajectory that is significant from the standpoint of results achieved. Operation of the laser emitter 2 and its associated beam forming apparatus is controlled by a control device 6 which has a connection with the firing mechanism 5 of the weapon as well as with the laser emitter 2.

Figure 3:
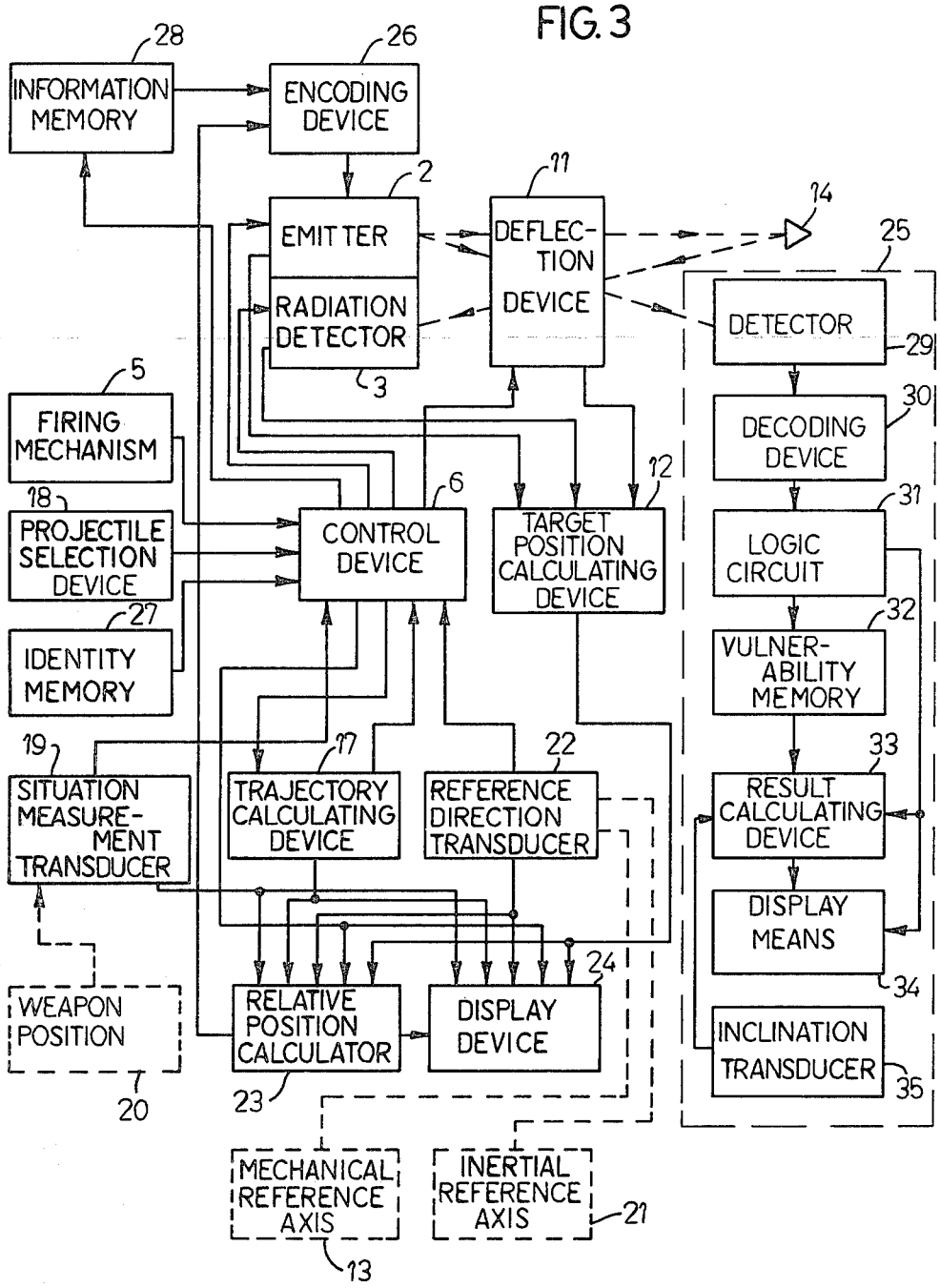
FIG. 3 is a block diagram of simulated weapons fire scoring apparatus embodying the principles of this invention.

Each of the target bodies 10, 10', 10'' at which simulated fire may be directed is equipped with at least one reflector 14. The location of reflectors 14 in relation to one another is further explained hereinafter, but at this point it should be noted that each reflector 14 is a so-called retroreflector or corner reflector by which incident radiation is reflected in the direction exactly opposite to that from which it arrived, so that when any reflector receives laser radiation from a weapon location 1, it reflects such radiation back to that same weapon location. (For clarity, radiation reflected from the reflector 14 is illustrated in FIG. 3 as being returned along a path divergent from the one along which it arrived at the reflector.) If a reflector 14 is installed on a movable target body, it is of course so arranged as to be capable of receiving and reflecting radiation in any normal orientation of the target body relative to a weapon location from which the reflector is visible. Since the reflector on a target body is a reference point for that target body rather than a target point as such, reflector positioning on target bodies can be based primarily on optical considerations.

Each of the pulsed beams 7', 7'' is long and narrow in cross-section 8', 8'', which is to say that each beam is elongated in a direction transverse to that of propagation. The beams have their long dimensions differently oriented so that every beam has its long cross-section dimension at an angle to that of every other beam, but they need not be at right angles to one another. Each beam is swept angularly back and forth in directions substantially transverse to its long dimension, so that collectively the beams sweep across a solid angle or more or less pyramid-shaped space that has the weapon location at its apex.

The pulsed beams 7', 7'' are emitted generally in the direction in which a target can be expected to appear, as further explained hereinafter.

Sweeping motion of the beams 7', 7'' is brought about in a known manner by means of a deflection device 11 (FIG. 3) that is associated with the laser emitter 2 and the detector 3 and is in their radiation paths. The deflection device 11, which can comprise mutually movable optical wedges, is actuated in response to signals from the control device 6. It so coordinates the beam sweeps that both beams 7', 7'' (or all of them, if there are more than two) sweep a solid angle that contains the target area 9 or can be expected to contain the target area. In the particular situation illustrated in FIG. 1, that solid angle has a cross-section as designated by 9''.

The beams have a predetermined rapid rate of periodic sweep, and their respective sweeps, which are coordinated with one another, occur during the course of a repetitive sweep cycle that has a predetermined duration.

Each time a beam 7', 7'' is intercepted by a reflector 14, a part of the beam radiation is reflected back to the weapon position and passes by way of the deflection device 11 to the detector 3. The detected radiation pulses are converted by the detector 3 into an electrical signal which is fed to a beam position calculating device 12. The calculating device 12 also receives a signal denoting the initiation of each pulse of radiation by the laser emitter 2. On the basis of the time interval between emission of a radiation pulse from the emitter 2 and detection of that same pulse at the detector 3, the calculating device 12 produces a signal that corresponds to the distance between the weapon location and the reflector 14 from which the reflected radiation was returned.

During its operation, the deflection device 11 produces signals that correspond to its momentary position in relation to a reference axis that is mechanically defined by a transducer 22. Hence the signals from the deflection device 11 correspond to the momentary angular position of each beam in its sweep, in relation to the mechanical reference axis. The nature of that axis and the manner of defining it are further explained hereinafter.

At this point it will be apparent that the mechanism comprising the emitter 2, the deflection device 11, the detector 3 and the calculating device 12 makes measurements concerning the position of a reflector or reflectors 14 in relation to the weapon location.

The apparatus at the weapon position also comprises a trajectory calculating device 17 that is connected with the firing mechanism 5 through the control device 6. Beginning at the instant of simulated firing, the trajectory calculating device 17 issues a trajectory signal which, at every instant, corresponds to the position in its trajectory 16 that a hypothetical projectile would have had if it had been shot from the weapon at the instant of simulated firing with the axis of the weapon barrel 4 oriented as it was at that instant and with regard for other factors that would significantly influence its trajectory. In most cases the trajectory calculation is made in real time, so that the imaginary projectile 15 moves in its calculated trajectory 16 at the same rate as a corresponding real projectile would move; but for some applications, as later explained, the trajectory calculation is accelerated.

The trajectory calculating device 17 can comprise a memory in which is stored information about a standardized trajectory, together with means for modifying that standardized trajectory in accordance with influencing factors. Before the instant of simulated firing, the gunner can signify the type of projectile he intends to fire, selected in accordance with the type of target body to be attacked. He does this by adjustment of a projectile selection device 18 which is connected with the trajectory calculating device 17 through the control device 6. The projectile selection device 18 issues an output to the trajectory calculating device 17 that modifies its trajectory calculation in accordance with the ballistic characteristics of the particular type of hypothetical projectile selected. Other factors that would significantly influence the standardized trajectory are the orientation of the axis of the weapon barrel 4 at the instant of simulated firing and the condition of motion of the weapon at that instant. The weapon orientation and motion magnitudes are measured automatically by a situation measurement transducer 19, which can comprise gyro and accelerometer means, and the inputs of which are symbolized by the box 20 in FIG. 3. Outputs corresponding to the magnitudes just mentioned are fed to the projectile trajectory calculator 17 through the control instrumentality 6. The calculated trajectory of the imaginary projectile is further modified in accordance with estimated values of random ballistic factors and influence of the atmosphere. If the imaginary projectile is of a type that can be guided after firing, the control signals employed for its guidance can be fed to the trajectory calculator 17 to further modify its trajectory output; and if the imaginary projectile is self-propelled, the trajectory output can be suitably modified, or the calculation can be based upon other stored information that is particularly applicable to the trajectory of such a missile.

The position of the projectile in range is of couse calculated in relation to the location of the weapon at the instant of simulated firing, and its position in directions transverse to the range direction is calculated in relation to a predetermined trajectory reference axis which can be arbitrarily chosen as explained hereinafter. At this point suffice it to say that the trajectory reference axis must have a known or readily ascertainable relationship to the mechanically defined beam position axis to which the angular positions of the beams are related.

It follows that there is a known or readily ascertained relationship at every instant between the calculated position of the imaginary projectile and the momentary angular position of each beam in its sweep. Of particular interest is the relation between angular beam position and projectile position at each of the instants when a reflection of the beam is returned to the detector 3 at the weapon position, since it is this relationship that can be employed for scoring.

At this point it is desirable to emphasize that a scoring system of the present invention takes a substantially different approach to scoring than prior simulation systems, and it will facilitate an understanding of the invention to repeat that the reflector 14 on a target body is not the target itself but a reference point for the target. When a beam in its sweep is intercepted by a reflector 14, the position of the reflector is measured in terms of range and angular position of the beam, and therefore when reflections of all beams have been received at the weapon location at the end of a sweep cycle, the position of the imaginary projectile in relation to the reflector position is known at the weapon location. And since the reflector can have a known relationship to any arbitrarily designated target point on the target body, or to a number of such points, scoring on the basis of calcualted position of the imaginary projectile in relation to measured position of the reflector permits accurate scoring of misses and near misses as well as of direct hits.

It will now be apparent that the information available at the weapon location can be employed in various ways to produce a display of scoring results, but in every instance scoring will be accomplished by comparing one measured magnitude for reflector position with a comparable calculated magnitude for projectile position until the compared magnitudes come into a predetermined relationship, and then scoring on the basis of the relationship between the remaining calculated projectile position magnitudes and the remaining measured reflector position magnitudes.

By way of specific example, comparison can be made from time to time after the firing instant between the calculated range distance of the imaginary projectile 5 from the weapon and the measured range distance of a reflector 14 from the weapon; and when those two range magnitudes are found to be equal, scoring is based upon the then-existing azimuth and elevation relationships between, on the one hand, the calculated position of the imaginary projectile and, on the other hand, the angular positions of the beams upon their interceptions by the reflector.

As another alternative, scoring data can be taken as of the instant at which a predetermined relationship exists between the elevation of the imaginary projectile 5 in its trajectory 16 and the elevation of the reflector 14. In that case, scoring will be based upon the relationships existing at that instant, first, as between measured weapon-to-reflector range distance versus calculated weapon-to-projectile range distance and, second, the azimuth relationship between the calculated position of the projectile and the measured azimuth position of the reflector as manifested by the angular positions of the beams when they are intercepted by the reflector. Note in connection with this last example that the absolute azimuth relationship of the reflector to the weapon location is of no consequence and need not be measured as such; all that matters with respect to azimuth data is the azimuth relationship between the calculated position of the imaginary projectile 5 and the position of the reflector 14.

Account is always taken of the momentary angular position of each beam at the instant at which it is intercepted by a reflector, and therefore in one sense it can be said that functions of the elevation and azimuth position of the reflector are measured by means of the beams; but here too it must be borne in mind that it is not the position of the reflector in absolute terms that is of interest but rather the relationship of the projectile trajectory to the beams in their various angular positions. This means that if there are two or more reflectors in the solid angle space swept by the beams, scoring can be accomplished on every such reflector, regardless of whether or not it is on a target body at which the gunner aimed. Normally, however, if there are plural reflectors in the target area 9, scoring results will be displayed only in relation to those reflectors that are within a predetermined range distance from the weapon and/or within a predetermined distance from the line of fire.

In order for information to be available about the relationship between instantaneous imaginary projectile position and instantaneous angular position of the beams there must be (as already mentioned) a known relationship between the trajectory reference axis and the mechanical reference axis to which angular beam positions are related.

The trajectory reference axis is chosen for its suitability to the type of projectile assumed to be fired. In general that axis will extend in a direction from the weapon towards the target, but it can be either fixed or constantly changing with changing positions of the imaginary projectile along its calculated path, so that the only firm requirement is that it have a known or ascertainable relationship to the mechanical beam reference axis. For example, the trajectory reference axis can be chosen as one that is fixed at the instant of simulated firing and remains fixed thereafter throughout the trajectory calculation, one such possibility being to establish it in coincidence with the weapon barrel axis at the firing instant. Or it can be an axis which changes from time to time during the progress of the imaginary projectile, as for example an axis that is aligned at every instant with the prevailing direction of flight of a guided missile. Although some function of the azimuth and elevation positions of the imaginary projectile must be calculated in relation to the chosen trajectory reference axis, the calculation need not be in terms of azimuth and elevation as much but can be, for example, in terms of angular direction and distance.

It will be apparent that the reference axis to which the angular positions of the beams is related can be one that defines the axis of symmetry of the solid angle space swept by the beams and can be swung about the weapon location by bodily shifting of the deflection device 11. The most suitable orientation of that axis depends upon circumstances, inasmuch as it should be oriented to propagate the beams generally in the direction in which a target can be expected to appear. Thus, in simulated firing of a surface mounted weapon against targets on the surface of land or water that are at distances such that the weapon need not have a high superelevation, the beams can be swept substantially horizontally, more or less symmetrically to an axis extending generally in a direction from the weapon to a target. Where the weapon is being fired with a high superelevation, the solid angle swept by the beams can have its axis of symmetry initially parallel to the weapon barrel axis at the firing instant and can thereafter be steadily swung downward until the detector 3 detects reflections of beam relationship returned from one or more targets within the expectable field of fire of the weapon. If the imaginary projectile is a self-propelled guided missile, the axis of symmetry of the solid angle space swept by the beams can be defined by the existing calculated direction of flight of the missile. In simulated firing against airborne targets, the axis of symmetry of the solid angle space can follow the calculated trajectory of the first imaginary round—and, if necessary, the trajectories of successive imaginary rounds—until reflections from a target reflector are picked up at the detector 3, after which the beam system can lock onto the target reflector in a known manner.

Control of the orientation of the mechanically defined beam position reference axis is a function of the reference direction transducer 22, which can comprise gyro means and the input to which is symbolized in FIG. 3 by the box 13.

The relationship between the hypothetical projectile and angular beam positions is calculated by means of a relative position calculator 23 that receives inputs from the trajectory calculating device 17 and the target position calculating device 12.

The trajectory calculation for the imaginary projectile 5 must be made on the basis of the location and state of motion that existed for the weapon at the instant of simulated firing. On the other hand, direct measurements made with the beams 7', 7'' can only be taken with respect to the momentarily prevailing location and state of motion of the weapon. Hence, if the weapon was stationary at the firing instant and begins to move during the calculated flight of the imaginary projectile, or if the weapon was moving at the firing instant and changes its speed and/or direction of motion during the trajectory calculation, there must be a compensation for such change of condition in the calculation of the relationships between projectile position and angular beam positions. A situation measurement transducer 19 takes account of the position and state of motion of the weapon at the firing instant and produces outputs which correspond to any subsequent changes in those values, which outputs are fed to the relative position calculator 23. The situation input to the situation measurement transducer 19, which is symbolized by the box 20 in FIG. 3, may be supplied from gyro and accelerometer means or from radio position and direction finding means or the like. The relative position calculator 23 also receives inputs from the reference direction transducer 22, which inputs correspond to the orientation of the mechanically defined beam axis, so that by a transformation of coordinates between the compared axes the relative position calculator can produce outputs which directly signify the relationship between hypothetical projectile position and angular beam position.

Figure 2:
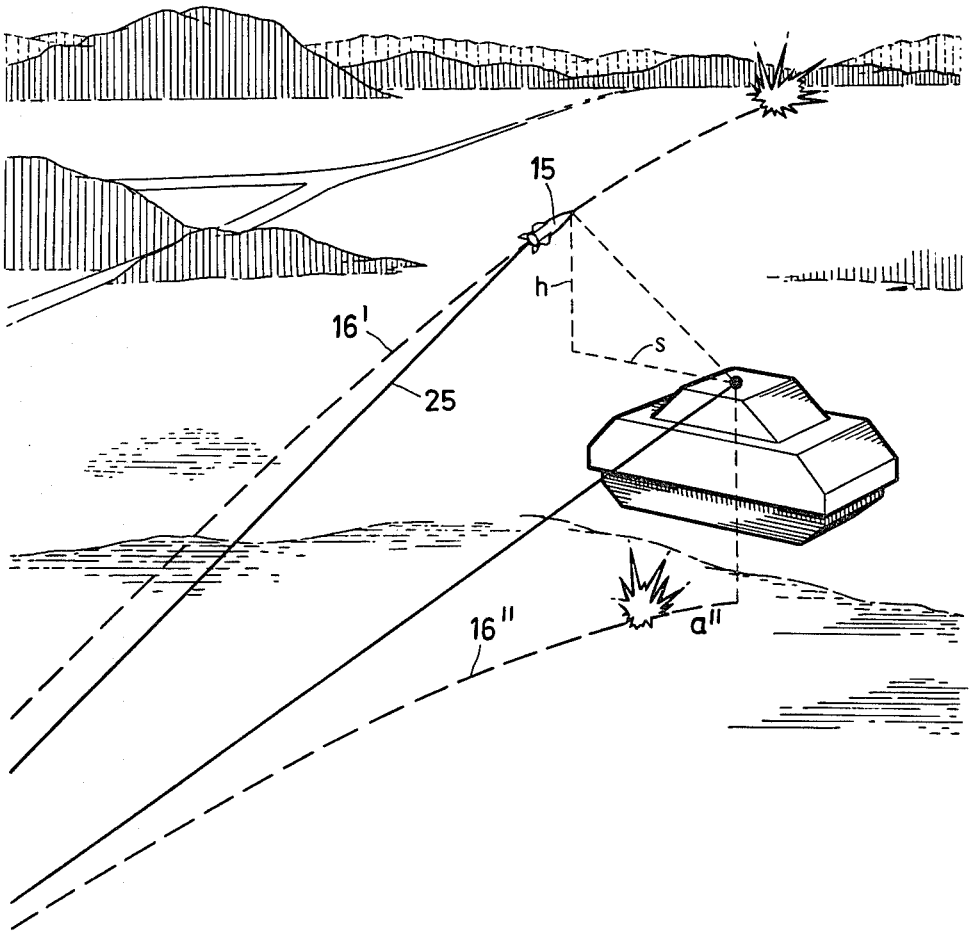
FIG. 2 is a view generally similar to FIG. 1 but depicting the calculated trajectories of imaginary projectiles assumed to be fired towards a target.

The results of the continuing comparisons between projectile and target positions that are made by the relative position calculator 23 can be employed and presented in various ways. Results can be displayed to the gunner, directly at the weapon location, by means of a display device 24 connected in parallel with the relative direction calculator 23. The position of the imaginary projectile in azimuth and in elevation can be displayed either in relation to the target itself or in relation to some point that has a predetermined relationship to the target, which point can be an optimum hit point in the target body. In an exercise wherein determination of target range and weapon barrel superelevation present major problems for the gunner, the position of the hypothetical projectile relative to the reflector 14 can be displayed as of the instant when the calculated position of the projectile in elevation is equal to a predetermined value; and the gunner then receives information about the point where a real projectile would have hit the target if it had been fired from the weapon as aimed or, if it would not have hit, at what distance from the hit point the projectile would have passed it. Distance from the target would preferably be given as elevation and azimuth deviations from the optimum hit point, which deviations are respectively designated by h and s in FIG. 2 for the imaginary projectile following the trajectory 16'. Such elevation and azimuth deviation indications would preferably be used when the imaginary projectile hits the target or terminates its trajectory behind the target. In the case of the trajectory 16'' shown in FIG. 2, in which the imaginary projectile arrived at ground elevation relative to the reflector 14 at a point in front of the target, the display device 24 would preferably indicate the distance a'' by which the imaginary ground burst fell short of the target.

When the relationship between the imaginary projectile and the target is displayed as of the instant that the imaginary projectile is at a calculated distance from the weapon location that is equal to the measured weapon-to-target range—with due compensation (as explained above) for weapon movement after the firing instant—the relationship between target and imaginary projectile at the scoring instant will preferably be displayed as elevation and azimuth distances.

Figure 9:
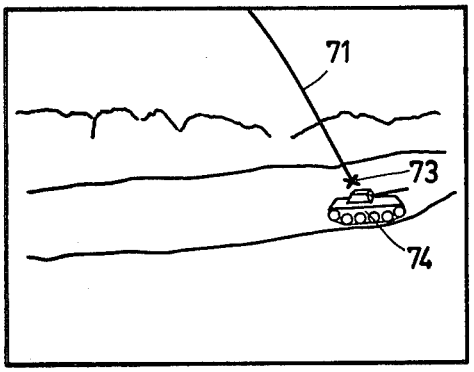
FIG. 9 shows the view that would be seen at the weapon sight in one embodiment of the invention, wherein at least the final portion of the trajectory of an imaginary projectile is visibly displayed for the gunner in the form of a moving point of light to depict for him the fall of a simulated shot.

FIG. 9 illustrates a desirable form of display to the gunner of the fall of the shot. The relationship of the imaginary projectile to the target is displayed in the form of a generated image projected into the gunner's gunsight, representing at least the final portion of the trajectory 71 of the imaginary projectile, depicted in the form of a moving point of light which momentarily increases in intensity at the burst point 73. In effect the gunner sees the calculated trajectory of the hypothetical projectile—or at least the final portion of that trajectory—as if he were watching a tracer bullet. The display can be generated by means of a cathode ray tube that serves as the display device 24.

Since the gunner's field of view through the gunsight will normally include the target 74 at which he directed the simulated fire, he will see the burst point 73 in relation to the target and thus be informed of the results he achieved.

From the explanation to this point it will be apparent that the invention lends itself to an appropriate and effective display at the weapon position of the results of simulated firing, without the need for any equipment at the target other than a retroreflector.

Since the relationship of hypothetical projectile position to beam position can be calculated and presented for every beam position in which a reflector intercepts the beam, it is recognized that if the beams and reflectors were arranged in accordance with heretofore conventional practices the presence of a number of reflectors in the target area swept by the beams could give rise to calculations based upon spurious reflector positions, due to a well known problem of ambiguity that previously arose with sweeping beam measurement systems when the number of reflectors was equal to or greater than the number of beams. However, the above mentioned copending application discloses expedients for solving and avoiding that ambiguity problem, and it is intended that the teachings of that application shall be employed in connection with the present invention. Therefore the disclosure of said copending application should be regarded as incorporated herein by reference.

To this point in the explanation of the present invention it has been shown how the invention can be employed for prompt and accurate scoring of results at the weapon location. In many cases, however, it is desirable that scoring information be displayed at the target position, such display being either in addition to display at the weapon location or instead of display at the weapon location. Display of scoring results at the target position would be of special importance in simulated combat training wherein each target body was manned and was itself a weapon location.

In general, for display of scoring results at a target body the sweeping beams are modulated to serve as a transmission medium, and the target body is equipped with a detector 29 of beam radiation that is located closely adjacent to its reflector 14. At the instant when a reflection of each beam is received at the weapon location, reflected from a reflector 14, the beam is modulated to encode information concerning the relationship between hypothetical projectile position and the momentary angular position of that beam, and since the modulated beam falls upon the co-located detector 29 at the same instant, the information carried by the beam is available at the target body. Normally, however, such a transmission is made only when the reflector 14 intercepted by a beam is found to be at a range distance from the weapon location which is equal to—or substantially equal to—the then-existing calculated range position of the imaginary projectile relative to the weapon location. In this way the beams are employed only to transmit information that is of practical significance to the target body receiving it so that there is no need to process large amounts of unnecessary information at the target position.

It will be seen that the information thus transmitted to each target body is essentially the same scoring information employed for the scoring display at the weapon location. In addition, the transmitted information can include information about the type of hypothetical projectile assumed to have been fired and an identification of the weapon that fired the simulated shot.

In addition to target body apparatus 25 that comprises the detector 29, scoring at the target body requires that the equipment at the weapon location comprise an encoding device 26 by which the beams are modulated in accordance with information to be transmitted to the target.

The encoding device 26 has an input connection from the relative position calculator 23 whereby scoring information about the relationship between the imaginary projectile and the target can be encoded in the beams during one or a few beam sweeps at or after the scoring instant. The encoding device 26 also has an input connection, through the control device 6, from an identity memory 27 in which is stored information that identifies the weapon being fired and the type of projectile assumed to be fired. The identity memory 27 is connected through the control device 6 with the projectile selector 18. The encoding device 26 also has a connection through the control device 6 with an information memory 28 in which is stored such information as is tied to the momentary angular positions of the beams in their sweeps or such information as is tied to a predetermined weapon-to-target distance. Thus, among other things, the information memory in cooperation with the control device can prevent transmission of scoring information to targets which are so far to each side of the path of the imaginary projectile that the information would be of no significance to them. The encoding device 26 organizes information to be transmitted, according to a predetermined pattern, into a binary word which is converted in a known manner into a series of pulses and pauses by which the radiation from the laser emitter 2 is modulated.

In the apparatus 25 at the target body, the detector 29 converts modulated laser radiation into an electrical signal that is fed to a decoding device 30. The decoding device 30 preferably converts the electrical signal from the detector 29 into the same form that the transmitted information had before it was encoded by the encoding device 26 for modulation of the laser emitter 2. A logic circuit 31 comprising a gate is connected with the decoding device 30. Under certain conditions that are explained hereinafter, the logic circuit 31 passes the output of the decoding device to a vulnerability memory 32 and to a result calculating device 33. The target apparatus also comprises display means 34 and an inclination transducer 35.

The response field of the target body detector 29 is such that it can receive laser radiation from a weapon location under all expectable shooting conditions, provided that the target body to which the detector is attached is not shielded. Further, the detector 29 should have the capability for determining the direction from which detected radiation reaches it, and to this end the detector can comprise a plurality of detector elements, each of which has a field of response that is limited to one sector of the total response field.

Figure 7:
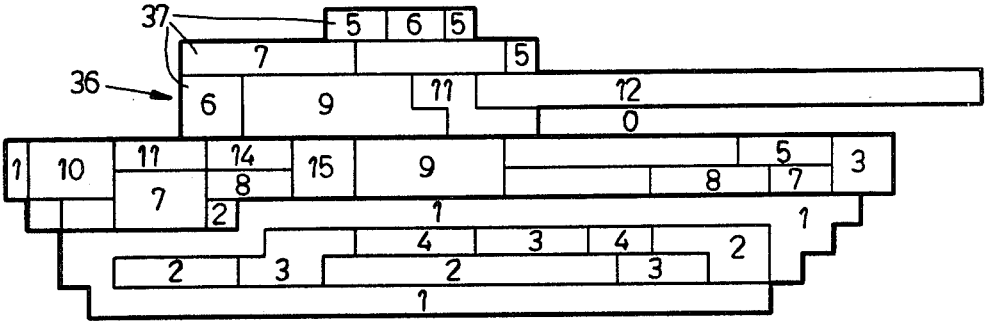
FIG. 7 is a profile view of a target body, showing how the same can be divided into zones of different vulnerability for the purpose of scoring hit effect in accordance with the principles of this invention.

In the vulnerability memory 32 there are stored, in the form of a table, numerical values denoting the vulnerability of each of the various parts of the target body to hits with predetermined types of projectiles, considering the target body as viewed from each of the directions covered by a detector element. The tubular vulnerability memory 32 thus constitutes, in effect, a representation of the target body such as is illustrated in FIG. 7, which depicts the side profile 36 of a tank, divided into zones 37 of different vulnerabilities, to each of which zones there is applied a number that signifies its vulnerability. The zero in FIG. 7 designates a zone that is outside the target body, and numbers from 1 to 15 are applied to zones in their order of increasing vulnerability.

On the basis of the information carried in beam modulation and the information stored in the vulnerability memory 32, the result calculation device 33 makes a calculation of the hit effect that would have been achieved by a real projectile of the type selected by the gunner if it had had the same trajectory as that calculated for the imaginary projectile and taking into account the vulnerability of the target body to such a projectile. Since the values in the vulnerability memory 32 are based upon a representation of the target body in its normal horizontal position, any actual tilting of the target body must be taken into account in the calculation performed by the result calculation device 33, and therefore that calculating device receives an input from the inclination transducer 35, which preferably has two channels, one for lengthwise tilting of the target body and one for lateral tilting.

The output of the result calculation device 33 is fed to display means 34 of any suitable type. If the target is manned, results can be displayed to personnel at the target, on a panel or the like that is provided for the purpose. The target can be caused to simulate damage done by the imaginary projectile, as, for example, if the target body is a tank and its drive mechanism would have been disabled by a hit scored on it, the drive mechanism can be stopped. To the gunner at the weapon location the effect upon the target body can be symbolized by means of simulated smoke puffs or lighted lamps or pyrotechnic displays on the exterior of the target body.

Figure 10:
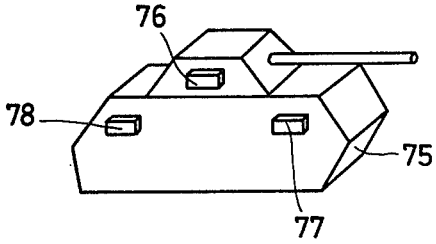
FIG. 10 is a side perspective view of a target body in the form of a tank having an arrangement of detectors for evaluation of defensive tactics on the part of the target body.

When scoring is conducted at the target, the invention lends itself to evaluation of defensive tactics as well as to scoring of fire directed at the target. FIG. 10 illustrates three detector-reflector pairs 76, 77, 78, each corresponding to the dectector 29 and its adjacent reflector 14 in FIG. 3, arranged on one side of a target body which is in this case illustrated as a tank 75, so that information can be automatically obtained at the target body on whether or not any part of it is protected from simulated weapon fire directed against it. If, for example, radiation is detected by the detector 76, but not by the detectors 77 and 78, this signifies that the lower portion of the target body was shielded (as by intervening terrain) and therefore impossible to hit.

It will be apparent that if there are several reflector-detector pairs 14, 29 that are at an appropriate range distance from the weapon location and within the space swept by the beams, all of them can receive scoring information unless transmission of scoring information is limited to, e.g., within a certain angle from the axis of the imaginary projectile trajectory. So that each detector 29 will receive only information valid for its co-located detector 14, each beam is modulated with scoring information only during the time that its radiation is being received at the weapon location, reflected from the target to which the information applies, and the logic circuit 31 of each receiving apparatus 25 is so arranged that scoring information is accepted only if it is encoded in the modulation of all beams during the course of a predetermined time interval, which time interval is at least equal to the duration of a complete sweep cycle of the beams.

For information about this and other expedients for preventing delivery of scoring information or other special information to an inappropriate one of several bodies in a space swept by modulated fan-shaped beams employed as a transmission medium, reference can be made to my copending application Ser. No. 14,116. In general, the principles disclosed in that application will be advantageously employed in connection with the present invention, and its disclosure is to be regarded as incorporated herein by reference.

Figure 5:
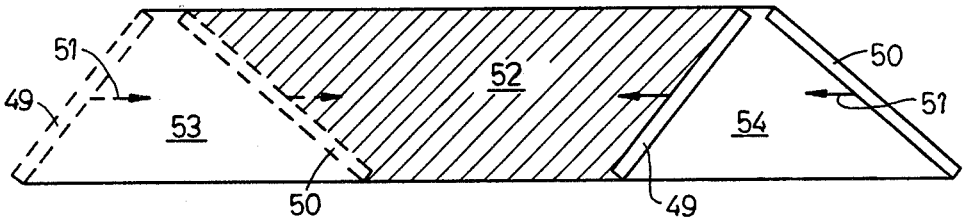
FIG. 5 is a view in cross-section of the space swept by the beams shown in FIG. 4.

Under certain circumstances it is advantageous for the beams to move in a fixed relationship to one another like that shown in FIG. 5. This permits the mechanism of the deflection device 11 to be substantially simplified. In the arrangement shown in FIG. 5, the two beams 49 and 50 have their long dimensions oriented at different angles oblique to the horizontal, and they sweep horizontally, as denoted by arrows 51, both always in the same horizontal direction and in a fixed spaced relation to one another. Because both beams sweep horizontally, it will be apparent that the solid angle or space 52 that they sweep can be substantially elongated horizontally, making the arrangement especially suitable for transmissions to target bodies confined to the surface of land or water. However, with the arrangement shown in FIG. 5 there are spaces 53, 54 at each side of the space 52 that are swept, in each case, by only one of the two beams. The presence of reflectors in the spaces 53 and 54 could somewhat complicate the calculations made by the target position calculating device 12 at the weapon location. Of course special information could not be delivered to bodies in the spaces 53 and 54 because the basic condition could not be fulfilled at such bodies that they receive scoring information from both of the two beams 49 and 50 with a predetermined time period. These disadvantages can be avoided by providing the optical system with a shield, preferably placed in an intermediate image plane, for masking off the spaces 53 and 54 that are each swept by only one of the two beams 49, 50.

Figure 4:
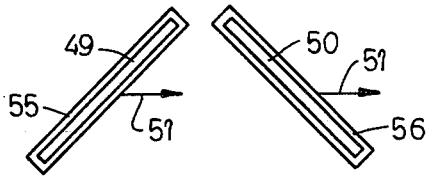
FIG. 4 illustrates an arrangement of laser beams and their associated scanning windows that can be employed in connection with the present invention.

With the arrangement as shown in FIG. 5, reflections from either beam could be detected at the weapon location 1 by the detector channel associated with the other beam. To prevent this, as shown in FIG. 4, the detector 3 at the weapon location 1 can have fields of response or scanning windows 55, 56, which are substantially matched to the cross-section shape and size of the beams 49 and 50, respectively, and which move with their associated beams. FIG. 4 represents the beams 49 and 50 and their respective fields of response 55 and 56 as seen in cross-section at an arbitrary distance in front of the weapon location 1. It will be understood that the fields of response 55, 56 can be defined by scanning means (not shown) for each channel of the detector 3, whereby the field of scan of the channel is limited to substantially the same portion of space that is illuminated by its associated beam 49 or 50.

The restricted scanning windows or fields of response 55 and 56 afford the further advantage of improving the signal-to-noise relationship and consequently affording a greater sensitivity and distance range than would be the case if the detector 3 had a single field of reception that covered both beams or the entire space swept by the beams.

Figure 6:
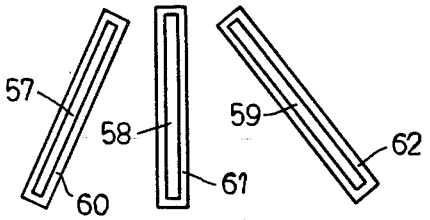
FIG. 6 is a view generally similar to FIG. 4 but illustrating a modified arrangement of beams and their associated scanning windows.

To reduce the possibility of information being delivered to targets for which it is not intended, more than two beams can be used to sweep the space in which the targets appear. Thus, FIG. 6 illustrates a beam arrangement in which there are three beams 57, 58, 59 which have their long cross-section dimensions oriented at different angles and which are all swept in common directions that are substantially transverse to their long dimensions, e.g., horizontally, as the beams are shown. For each beam 57, 58, 59 there is a field of response or scanning window 60, 61, 62, respectively, which is matched to the shape and size of the beam cross-section and moves with the beam. It will be evident that this arrangement facilitates discrimination between reflectors, reduces the possibility for spurious reflector positions, and increases selectivity of information transmission.

For scoring of simulated firing of heavy weapons, it is usually advantageous from the standpoint of realism to produce the calculation of the imaginary projectile trajectory in real time, that is, at a rate that substantially corresponds to the movement of an actual projectile along its path. In practice firing with simulation of certain projectiles, however, a real-time calculation of the projectile trajectory is not suitable. This can also be the case with air-to-ground firing or with the firing of certain mobile weapons, where the weapon is quickly turned away from the target after simulated firing so that the beams could not sweep the target reflector at the time corresponding to arrival of the projectile at the target.

Figure 8:
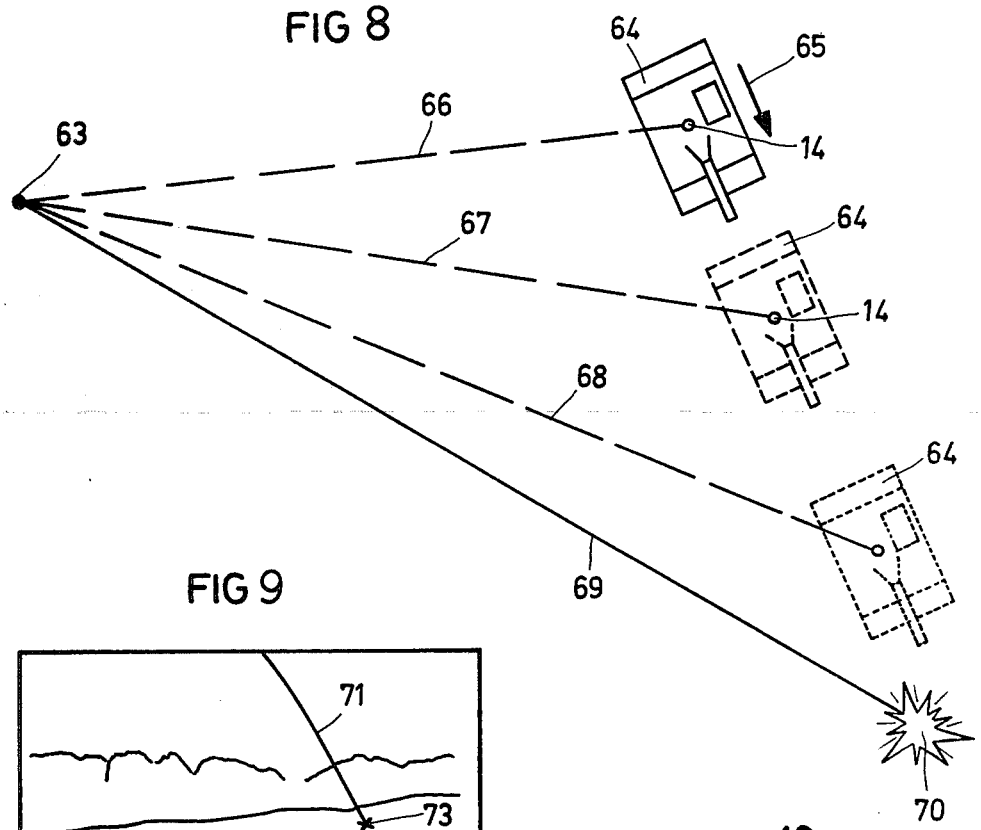
FIG. 8 is a plan view illustrating how a predicted position for a target body can be ascertained by repeated measurements by means of a system such as is illustrated in FIG. 3.

In such instances, instead of taking measurements of the target position to and through the end of the real-time period of flight of the imaginary projectile, a procedure can be followed such as is illustrated in FIG. 8 wherein the location of a tank defense weapon is designated by 63. The weapon is assumed to be aimed at a target tank 64 that is moving in the direction indicated by the arrow 65. At the instant of simulated firing a measurement is taken at the weapon location, as previously described, of the position of the reflector 14 of the target tank 64 relative to the weapon location 63, and at that time the line of sight between the reflector 14 and the weapon location 63 is as designated by 66. By a measurement made shortly thereafter, the line of sight is found to have advanced to the position designated by 67. From these measurements an unambiguous calculation can be made of a predicted position of the tank at the conclusion of the trajectory flight time, which predicted position will be along the line 68. This predicted position can be compared with a calculated position of the imaginary projectile, determined from an accelerated calculation. In the situation illustrated in FIG. 8 the calculations show that the imaginary projectile would terminate its flight at a burst point 70 ahead of the predicted position of the target, signifying that the gunner aimed with too much lead on the target tank 64. Since the calculation of both predicted target position and burst point, in relation to one another, can be made very rapidly, the results of the simulated shot can be displayed directly to the gunner and can also be transmitted to the target position.

Figure 11:
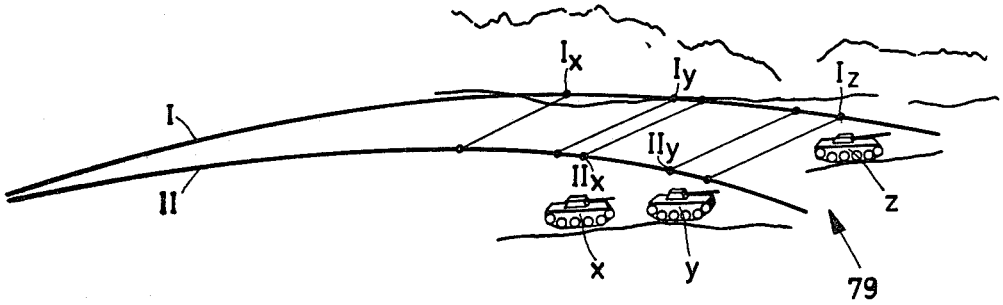
FIG. 11 is a perspective view illustrating how results are scored in accordance with the principles of this invention when a series of imaginary projectiles are fired in rapid-fire sequence towards a group of target bodies.

In the preceding description it has been assumed that projectiles were fired one-by-one, but the invention also lends itself to scoring of simulated firing with rapid-fire weapons. For this purpose the trajectory calculator 17 is caused to produce signals that correspond to the calculated trajectory for each successive projectile in turn, so that it may be calculating portions of two or more trajectories simultaneously. FIG. 11 illustrates the calculated trajectories I and II of a first and a second projectile, respectively, that were assumed to be fired in rapid succession from a rapid-fire weapon (not shown), in their relations to three target bodies x, y and z occupying terrain designated by 79. At the points Ix and IIx the projectiles following trajectories I and II are respectively at the same distance from the weapon location as the target x; at the points Iy and IIy the same projectiles are respectively at the same distance from the weapon location as the target y; and at the point Iz the projectile following the trajectory I is at the same distance from the weapon location as the target z. For scoring purposes, the relationship of the projectiles to the targets is calculated in the chronological sequence in which the projectiles arrive at the respective positions designated in the figure. Thus, the elevation and azimuth relationships of the projectiles to the targets will be calculated in the sequence: Ix, Iy, IIx, IIy, Iz.

Although laser radiation is particularly suitable for the practice of the present invention, it will be apparent that it would be possible to employ any optical radiation capable of being modulated. However, it is advantageous that the radiation be as nearly as possible monochromatic so that a narrow-band optical filter can be used in conjunction with each of the detectors 3 and 29 to suppress disturbing background radiation and provide the system with high sensitivity.

From the foregoing description taken with the accompanying drawings will be apparent that this invention provides a system for scoring simulated weapon fire with the use of fan-shaped beams of radiation that sweep flatwise angularly. It will also be apparent that the system of this invention is more versatile than prior simulated weapon fire scoring systems in that it is applicable to a variety of different types of weapons and virtually all tactical situations, and it is also more accurate than prior such systems, particularly in that it makes possible the scoring of the precise results obtained on a particular target body with a hit or a near miss by a specifically selected type of projectile assumed to have been fired.

The invention is defined by the following claims.

I claim:

1. A method of scoring simulated firing of a weapon against a target which comprises a reflector whereby radiation such as that of a laser is reflected back in the direction opposite to the one from which it arrived at the reflector, said method being characterized by:

A. beginning at the instant of simulated firing of the weapon, generating at the weapon location a calculated trajectory output which substantially signifies the position that a hypothetical projectile would have in its trajectory at successive instants if it had been fired from the weapon at the instant of simulated firing and which comprises
   (1) calculated range magnitudes related to the location of the weapon at said instant, and
   (2) other calculated position magnitudes which are related to a predetermined axis extending from the weapon generally in a direction in which the trajectory is oriented;

B. emitting radiation from the weapon location in the form of at least two fan-shaped beams, each having a long cross-section dimension which increases with increasing distance from the weapon location and a narrow cross-section dimension transverse to said long dimension,
   (1) said long dimension of every beam at an angle to that of every other beam, and
   (2) each of said at least two beams being swept angularly, substantially transversely to its said long dimension, across a solid angle space which has the weapon location at its apex;

C. each time radiation of a beam in its sweep is returned to the weapon location by reflection from said reflector, generating at the weapon location a measured output which comprises
   (1) a range magnitude (a) which is determined on the basis of time elapsed between emission of radiation and detection of the reflection thereof at the weapon location and (b) which is a function of the distance between the reflector and the weapon location and is thus comparable with said measured range magnitude, and (2) a beam angle magnitude which is a function of the then-existing angular position of the beam and which is related to said axis and is thus comparable with at least one of said other calculated position magnitudes; and D. from time to time comparing one of said measured magnitudes with the comparable calculated magnitude so that when a predetermined relationship between the compared magnitudes is found to exist, the remaining calculated magnitudes can be compared for scoring purposes with the remaining measured magnitudes.

2. The method of claim 1 wherein said one measured magnitude and said one calculated magnitude that are compared are range magnitudes.

3. The method of claim 1 wherein said one measured magnitude and said one calculated magnitude that are compared are elevation magnitudes.

4. The method of claim 1 wherein the comparison of said one measured magnitude with said comparable calculated magnitude takes place at the weapon location.

5. The method of claim 1 wherein a detector of beam radiation is located adjacent to the reflector, further characterized by:

E. encoding in modulation of each beam, during a time when reflection of its radiation returned from the reflector is detected at the weapon location, information corresponding to the relationships between functions of said measured magnitudes and said calculated magnitudes so that scoring can take place at the reflector position.

6. The method of claim 5 wherein said sweep cycle has a predetermined duration, further characterized by:

F. at the reflector position, accepting information concerning relationships between said magnitudes only upon the condition that such information is detected in the modulation of every beam during a predetermined period having a duration not less than that of a sweep cycle during which every beam makes at least one sweep.

7. The method of claim 1, further characterized by: modifying one of said outputs during said period to compensate for departures of the weapon location and the weapon barrel axis orientation from their conditions at the instant of simulated firing.

8. The method of claim 1 wherein rapid firing of the weapon is simulated by generation, during a period following initiation of simulated firing, of a plurality of calculated trajectory outputs which begin successively and certain of which begin to be generated while generation of another continues, and wherein reflections of radiation may be received at the weapon location from a plurality of reflectors during said period, further characterized by:

(1) at the weapon location comparing each of the calculated range magnitudes with each of the measured range magnitudes; and (2) as the calculated range magnitude of each of said trajectory outputs comes into equality with a measured range magnitude, generating an output which signifies the relationship between said other calculated position magnitudes of that trajectory output and the then-existing beam angle magnitudes.

9. Apparatus for scoring results obtained in simulated firing with a weapon that has a barrel and a firing mechanism, said apparatus being of the type comprising a radiation emitter at the weapon location, a target that comprises a reflector whereby radiation is reflected back in the direction opposite to that from which it arrived, and a radiation detector, said apparatus being characterized by:

A. beam forming means at the weapon location, operatively associated with said radiation emitter, for forming emitted radiation into a plurality of fan-shaped beams, each of which is elongated in one direction transverse to its direction of propagation and each of which has its said long dimension at an angle to that of every other beam;

B. beam sweep means operatively associated with said radiation emitter and with said beam forming means and arranged to sweep each beam angularly, substantially transversely to its said dimension, in a regular relationship to the sweep of every other beam, so that the beams collectively have a regular sweep cycle;

C. control means at the weapon location, having an input connection with said firing mechanism and having output connections with said radiation emitter and with said beam sweep means, for initiating a period of repeated sweep cycles upon simulated firing of the weapon;

D. said detector being at the weapon location and being arranged to detect beam radiation reflected back to said location;

E. target range measurement means at said weapon location, connected with said radiation emitter and said detector, for producing during each sweep cycle a target range output which corresponds to a function of the distance between the target and the weapon location;

F. beam position measurement means at said weapon location, connected with said detector and with said beam sweep means, for producing during each sweep cycle beam position outputs corresponding to functions of the angular position of each beam in its sweep at the instant when beam radiation, reflected back from the reflector, is detected at the weapon location;

G. imaginary projectile trajectory output means at the weapon location, having an input connection with said control means, for generating (1) a projectile range output corresponding to the distance between the weapon location and the instantaneous position that a real projectile would have in its trajectory if it had been fired from the weapon at the instant of simulated firing, and (2) projectile position outputs corresponding to functions of the instantaneous position of said projectile in relation to said angular positions of the beams; and H. comparison means at the weapon location, connected with said measurement means and with said trajectory output means to receive their outputs and compare them with one another, said comparison means being arranged to produce a scoring output at a scoring instant when there is a predetermined relationship between one of said outputs of the measurement means and a corresponding one of said projectile outputs, which scoring output signifies a relationship between the imaginary projectile and the target at said scoring instant.

10. The apparatus of claim 9, further characterized by:

I. means at the weapon location, connected with said comparison means, for modulating the beams with information corresponding to said scoring output;

J. another detector adjacent to said reflector; and

K. display means connected with said other detector for producing at the target at perceptible output appropriate to the information with which the beams are modulated.

11. The apparatus of claim 10, further characterized by:

L. logic circuit means connected between said other detector and said display means, said logic circuit means being arranged to pass information corresponding to said scoring output from said other detector to said display means only upon the condition that every beam is modulated with such information during a predetermined time interval having a duration at least equal to that of said sweep cycle.

12. The apparatus of claim 9, further characterized by:

I. display means at the weapon location, connected with said comparison means, for producing at the weapon location a perceptible output appropriate to said scoring output.

* * * * *

UNITED STATES PATENT AND TRADEMARK OFFICE

CERTIFICATE OF CORRECTION

PATENT NO. : 4,218,834

DATED : August 26, 1980

INVENTOR(S) : Hans R. Robertsson

It is certified that error appears in the above-identified patent and that said Letters Patent is hereby corrected as shown below:

Col. 5, lines 38-39, "measured" should be --calculated--

Col. 19, line 7, "measured" should be --calculated--

Signed and Sealed this

*Fifth* Day of *November 1985*

[SEAL]

*Attest:*

DONALD J. QUIGG

*Attesting Officer*

*Commissioner of Patents and Trademarks*